US010080445B2

(12) United States Patent
Da Silva et al.

(10) Patent No.: US 10,080,445 B2
(45) Date of Patent: Sep. 25, 2018

(54) DISPLAY RACK

(71) Applicant: LIDL STIFTUNG & CO. KG, Neckarsulm (DE)

(72) Inventors: Flavio Da Silva, Stuttgart (DE); Christoph Hopfenzitz, Stuttgart (DE); Alexander Seestaller, Immenstadt (DE)

(73) Assignee: LIDL STIFTUNG & CO. KG, Neckarsulm (DE)

( * ) Notice: Subject to any disclaimer, the term of this patent is extended or adjusted under 35 U.S.C. 154(b) by 37 days.

(21) Appl. No.: 14/764,850

(22) PCT Filed: Jan. 29, 2014

(86) PCT No.: PCT/EP2014/051677

§ 371 (c)(1),
(2) Date: Oct. 29, 2015

(87) PCT Pub. No.: WO2014/118203

PCT Pub. Date: Aug. 7, 2014

(65) Prior Publication Data

US 2016/0058205 A1 Mar. 3, 2016

(30) Foreign Application Priority Data

Jan. 30, 2013 (DE) ..... 20 2013 100 425 U
Sep. 17, 2013 (DE) ..... 20 2013 104 239 U
Nov. 26, 2013 (DE) ..... 20 2013 105 382 U

(51) Int. Cl.
*A47F 1/12* (2006.01)
*A47F 3/02* (2006.01)
(Continued)

(52) U.S. Cl.
CPC ..... *A47F 1/12* (2013.01); *A47F 3/02* (2013.01); *A47F 5/0018* (2013.01); *A47F 7/0071* (2013.01); *A47F 2003/021* (2013.01)

(58) Field of Classification Search
USPC ..... 221/197; 211/59.3, 59.2
See application file for complete search history.

(56) References Cited

U.S. PATENT DOCUMENTS 2,234,032 A * 3/1941 West ..... A47F 3/00 206/558
2,356,687 A * 8/1944 O'Reilly ..... G07F 9/10 211/128.1

(Continued)

FOREIGN PATENT DOCUMENTS

DE 3019463 A1 11/1981
DE 3223804 C1 3/1984

(Continued)

OTHER PUBLICATIONS

United States Patent and Trademark Office, Office Action for U.S. Appl. No. 15/630,531, Mar. 28, 2018, 22 pages.

*Primary Examiner* — Timothy R Waggoner
*Assistant Examiner* — Ayodeji T Ojofeitimi
(74) *Attorney, Agent, or Firm* — Kolisch Hartwell, P.C.

(57) ABSTRACT

A display rack for the presentation and dispensing of products which have to be protected in a hygienic manner, in particular foodstuffs, to a customer. The display rack has a presentation chamber for storing and visually presenting the products, having a front side which faces a customer, a rear side which is remote from a customer as well as a left-hand side and a right-hand side. The display rack also has a removal chamber having a removal opening for the removal of products from the display rack. A non-return device is provided between the presentation chamber and the removal chamber, and is arranged on the right-hand and/or left-hand side of the presentation chamber. Two panes are arranged one above the other as front covers for the front sides of the presentation chambers to define a pusher opening in a width direction.

21 Claims, 7 Drawing Sheets

Figure 1A:
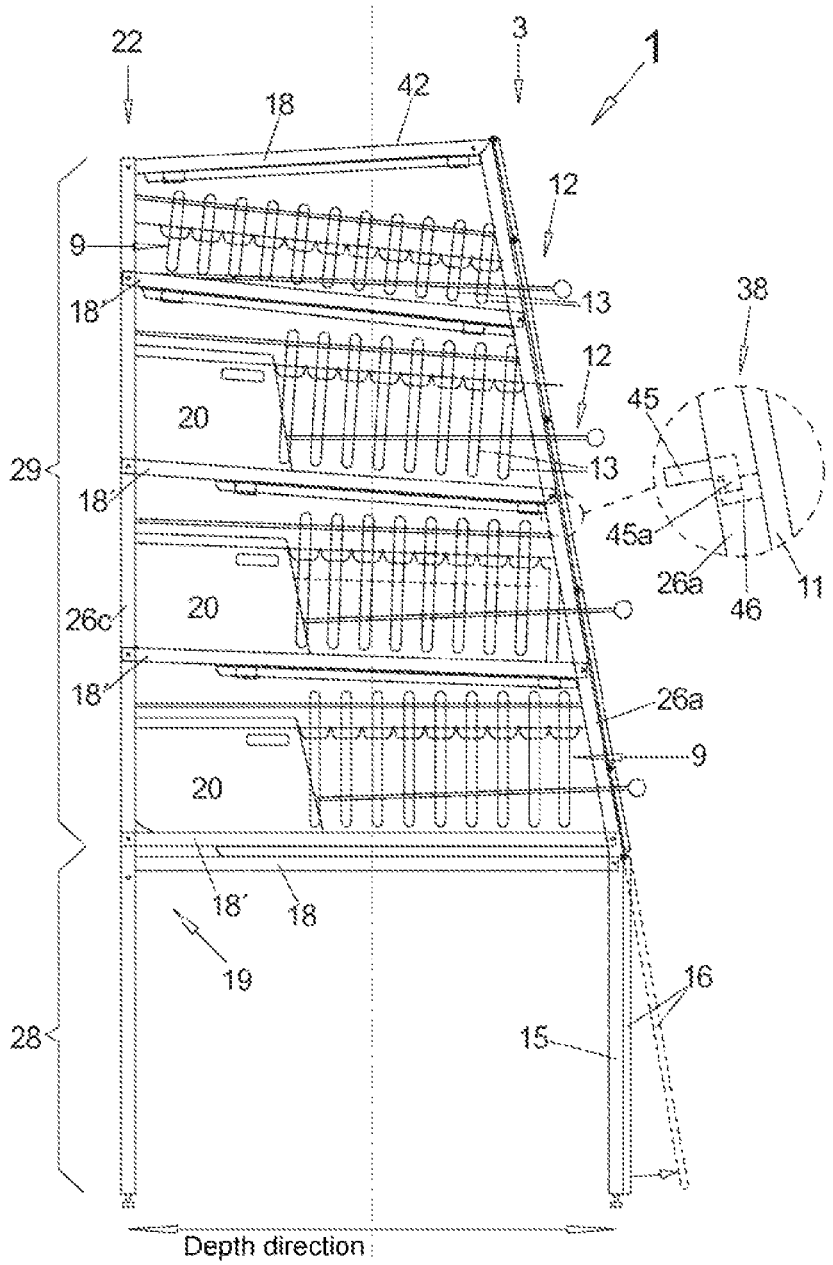

(51) Int. Cl.
*A47F 5/00* (2006.01)
*A47F 7/00* (2006.01)

(56) References Cited

U.S. PATENT DOCUMENTS

| | | | | |
|---|---|---|---|---|
| 2,919,051 | A | 12/1959 | Wideburg et al. | |
| 2,940,642 | A | 6/1960 | Strattman | |
| 3,911,248 | A * | 10/1975 | Buday | A47F 3/04 126/21 A |
| 7,340,856 | B1 * | 3/2008 | Kalouris | G09F 3/204 24/16 PB |
| 2002/0072323 | A1 | 6/2002 | Hakemann | |
| 2002/0170240 | A1 * | 11/2002 | Thompson | E04B 2/7433 52/36.1 |
| 2006/0180602 | A1 | 8/2006 | Hertal | |
| 2007/0194037 | A1 * | 8/2007 | Close | A47F 1/126 221/100 |
| 2008/0029517 | A1 | 2/2008 | Briers | |
| 2008/0179343 | A1 * | 7/2008 | Perkins | G07F 11/165 221/208 |
| 2009/0277924 | A1 * | 11/2009 | Kottke | A47F 1/12 221/279 |
| 2010/0014288 | A1 * | 1/2010 | Kreutzer | A47F 3/001 362/231 |
| 2010/0237093 | A1 * | 9/2010 | Lockwood | A47F 1/126 221/279 |

FOREIGN PATENT DOCUMENTS

| | | | |
|---|---|---|---|
| DE | 9305088 | U1 | 10/1993 |
| DE | 4412503 | A1 | 10/1995 |
| DE | 9412893 | U1 | 10/1995 |
| DE | 29510894 | U1 | 11/1995 |
| DE | 29510232 | U1 | 2/1996 |
| DE | 29518948 | U1 | 2/1996 |
| DE | 29518950 | U1 | 2/1996 |
| DE | 20114012 | U1 | 12/2001 |
| DE | 202004009530 | U1 | 10/2004 |
| DE | 202005009376 | U1 | 9/2005 |
| DE | 202007014304 | U1 | 1/2008 |
| DE | 102006013435 | B4 | 3/2008 |
| DE | 202007006139 | U1 | 10/2008 |
| DE | 202007009953 | U1 | 12/2008 |
| DE | 202008001290 | U1 | 7/2009 |
| DE | 202009006328 | U1 | 8/2009 |
| DE | 102005049193 | B4 | 9/2009 |
| DE | 202009008829 | U1 | 10/2009 |
| DE | 202011104571 | U1 | 1/2012 |
| DE | 202011104060 | U1 | 12/2012 |
| DE | 202011106702 | U1 | 3/2013 |
| DE | 202013100425 | U1 | 3/2013 |
| DE | 202013105382 | U1 | 1/2014 |
| EP | 0618154 | B1 | 12/1996 |
| EP | 1669009 | A1 | 6/2006 |
| EP | 1688042 | A2 | 8/2006 |
| EP | 1728456 | A1 | 12/2006 |
| EP | 2084995 | B1 | 10/2011 |
| EP | 2248447 | B1 | 10/2011 |
| EP | 2248448 | B1 | 10/2011 |
| EP | 2570054 | A1 | 3/2013 |
| WO | 8907902 | A1 | 9/1989 |
| WO | 2014118202 | A1 | 8/2014 |
| WO | 2014118203 | A1 | 8/2014 |

* cited by examiner

DISPLAY RACK

I. SCOPE OF APPLICATION

The invention relates to a display rack by way of which foodstuffs that have to be protected in a hygienic manner, for example baked goods, are able to be presented to customers and dispensed to said customers. The display rack comprises at least one presentation chamber in which the foodstuffs are presented and are able to be presented visually to the customers, as well as at least one removal chamber which comprises a removal opening through which the foodstuffs are able to be removed by the customer from the display rack.

II. TECHNICAL BACKGROUND

In food stores and supermarkets, non-packaged foodstuffs are increasingly offered to customers for self-service in self-service counters or racks.

In the case of fruit, this has up to now been without any hygienic protection as it is assumed that fruit and vegetables will be peeled, cooked or washed by the customer before consumption. It is different, for example, for baked goods. In this case, it is necessary to provide the baked goods with hygienic storage and hygienic presentation and removal, all of which are regulated by legislation.

When offering the goods, that is the presentation and removal of the baked goods, it must be ensured in particular that a customer does not take the baked goods from the rack, touch them and then put them back into the rack. In addition, it must be ensured that bacteria or contaminants are not passed to the goods by air, for example by a customer sneezing or coughing. The tendency of the customer to put removed goods back into the rack can be reduced considerably as a result of the customer not inadvertently removing several items of food from the rack and then putting the food items not needed back into the rack. This can be brought about by as a result of single removal being supported by the display rack. A further demand is that the rack should be cleanable in a simple manner, for example for removing small crumbs or icing in the case of cakes or other sweet baked goods.

These demands are met in different ways by the known display racks. Display racks are frequently developed such that the customer is only able to remove the good using a tool. In this case, he has to convey the goods beyond a barrier using tongs or a pusher, by means of which barrier placing the goods back into the presentation chamber is prevented. Once the goods have been conveyed beyond the barrier, the goods are situated in the majority of cases in a removal chamber into which the customer is able to reach with his hand.

EP 2 084 995 B1 makes known a dispensing device for bread, bread rolls or similar non-packaged foodstuffs where exchange boxes are realized in a product-specific manner, for example corresponding to the size of the bread rolls or baked goods in the form of baguettes, loaves or the like, with a respective storage volume such that the customer is able to remove the baked goods though a front flap. In this case, a module of a display rack consists of a presentation chamber, in which the baked goods are stored, and a removal chamber, which is located between the presentation chamber and the customer and into which the customer is able to reach through the front flap in order to remove the baked goods.

Dispensing devices are additionally known where between a presentation chamber and a removal chamber there is arranged a non-return means through which the baked goods are able to be conveyed out of the presentation chamber into the removal chamber, but not back into the presentation chamber from the removal chamber.

A disadvantage in the case of said realization is that the customer has to look through the removal chamber in order to be able to look at the goods in the presentation chamber. As a result of the removal chamber being located between the customer and the presentation chamber, the removal of the goods or their conveying out of the presentation chamber into the removal chamber, in particular if they are situated at the end of the presentation chamber that is remote from the customer, is made difficult for the customer.

Over and above this, said structure also makes the removal of individual components difficult, for example the floors of the removal chambers and of the presentation chambers and of the non-return means.

III. REPRESENTATION OF THE INVENTION a) Technical Object

The object underlying the invention, consequently, is to develop a display rack where the customer has the goods directly in front of him in the presentation chamber and is able to look at them and where simple removal of the goods is ensured at the same time.

b) Achievement of the Object

Said object is achieved by a display rack with the features of claim 1. Further features of the invention are produced from the sub-claims.

Arranging the removal chamber not in front of but to the side next to the presentation chamber achieves the advantage of the products being easy to see in the presentation chamber, unimpaired by a removal chamber located in front of it, since simply a completely transparent pane, as a front cover, is situated in between.

By the display rack consisting of a frame, which has upright struts and as well as cross struts and longitudinal struts which extend widthwise and depth wise, in which all the other components are releasably fastened, the display rack is easy to clean. The bottommost longitudinal and cross struts are situated, in this case, not just above the floor, but are offset upward from the bottom end of the upright struts up to the bottom end of the presentation region, in which the presentation chambers and removal chambers are situated in storeys one above another. The base region, which is situated below and in which there are not any presentation or removal chambers, does not include any longitudinal or cross struts such that it is easily possible to clean the floor, on which the upright struts stand, around said upright struts using a brush or other cleaning devices.

For this reason, the front side of the base region is also closed by way of a front plate, which is realized as a flap, that is to say is fastened by way of its top edge in an articulated manner on the frame, in particular the bottommost longitudinal strut, such that the bottom edge of the front plate is able to be pivoted forward away from the display rack, and in particular only in this direction, for example because the front plate abuts against the front side of the upright struts.

This opens up the possibility, when cleaning the ground under the display rack with, for example, a brush, to sweep any breadcrumbs lying there forward through under the front plate which, at the same time, swings open into the region in front of the display rack where the small crumbs or breadcrumbs are then picked up by a sweeping or cleaning machine which is working there.

By the longitudinal struts only being present between the upright struts at the top end of the frame and at the transition between the base region and the presentation region, a particularly simple design is produced which facilitates the insertion of the necessary modules on the individual storeys for forming the individual presentation and removal chambers.

In the case of the presentation chambers, the upright struts should preferably reach as far as down to the ground at most on one side of the removal chamber, ending on at least one side, in contrast, at the transition between the presentation region and the base region. Avoided as a result are any upright struts which are spaced closely together on the ground, between which the cleaning, for example sweeping by means of a clearly wider brush, would be a problem.

By all the struts being releasably connected together, for example screw-connected, the display rack can be lengthened in the width direction in an arbitrary manner, preferably by a presentation chamber and a removal chamber always being present in an alternating manner.

Insofar as the presentation chamber is not divided into two part chambers in the width direction, products can be dispensed from a presentation chamber selectively into each of the two removal chambers on both sides of the presentation chamber, and on a reverse manner products can be dispensed from the two adjacent presentation chambers into one removal chamber.

By the struts of the frame being closed hollow profiles in cross section, electrical wiring, for example for the illumination of the display rack, can be laid in a well-protected manner in their interior.

The individual presentation chambers and removal chambers located one above another are formed by cassettes, for example in the form of a storage bin or a removal bin, being inserted in the depth direction into the frame, said cassettes, on the one hand, forming the support surface for the products and, on the other hand, the vertical separation between presentation chambers or removal chambers which are located one above another.

The guide means in the depth direction for the metal sheets are preferably realized as guide strips which extend between the upright struts in the depth direction. In this case, the guide strips preferably slope down to the front at the same angle as the removal bin and the storage bin. The storage bin and removal bin can obviously also consist of material other than metal, for example plastics material.

The storage bin and/or removal bin are preferably developed in a bin-shaped manner by comprising an edge which rises toward the side and aids against a product being unintentionally pushed out of the storage bin.

The floor of the storage bin and/or of the removal bin is provided on its top surface with grooves which extend in the width direction and, in particular, cover the entire floor area in the depth direction. The grooves preferably have a V-shaped profile and the elevations between the grooves are rounded at the top, but preferably do not have a level top surface.

The elevations between the grooves consequently serve, on the one hand, as a supporting surface for the products and, on the other hand, as a guide means when the products are pushed to the side, whilst the grooves themselves serve as a collecting point for crumbs or grains that have fallen off the products. At their front end, the storage bins additionally have a steeply rising bevel which is to prevent the products reaching the pane at the front side and contaminating it.

Subdividing a storage bin into two part chambers can be effected, for example, by a partition wall which extends in the depth direction and rests on the floor of the storage bin.

The upright partition wall is held, in this case, by a bar, which is preferably produced from metal, is fixedly connected to the bottom region of the partition wall and has a cross section and a length such that it is able to be placed into one of the grooves of the storage bin, and as a result holds the partition wall in position.

The grooves preferably have such a depth that—considering the inclined position of the storage bin with respect to the horizontal and to the line of vision of the customer—the deepest region of the grooves cannot be seen by the customer at least in the topmost storey of the display rack and he consequently cannot see the crumbs already collected there either and consequently from his point of view the storage bin is clean.

Said effect can also be promoted by the profile form of the grooves, in particular by a flank of the groove which is as steep as possible, is in particular perpendicular to the main plane and is the closest in each case to the customer. In the ideal case, said flank of the groove which points away from the customer would even be developed in a slightly overhanging manner, which certainly does make cleaning slightly more difficult but always creates a clean visual impression of the storage bin.

The depth of the trough-shaped storage bin or removal bin can be different depending on the product to be accommodated therein. The grooves do not always have to be present either, for storage bins are also needed in order to present packaging bags, for example, preferably on the bottommost storey, and as no crumbs fall from said bins, the grooves as a collecting possibility are not necessary for this either.

The display rack additionally includes on each floor a price strip with a price ticket, in order to display the price of the products presented there, which also has to be rapidly and easily exchangeable. In addition, the price strip must not be reachable by the customer.

For this purpose, on each storey behind the pane, that is inside the display rack, a holding bar is arranged extending transversely in front of the corresponding storage bin and is suspended by way of the ends in each case in one of the upright struts.

A pocket profile, which is produced preferably from transparent plastics material, hangs down from said holding bar, the top and bottom regions of which pocket profile are offset from the front side to the back or to the front, in the above case are offset 3 times such that a top pocket which is almost closed on all sides is created, into which the holding bar fits, therefore the pocket profile can be clipped, for example, onto the holding bar by way of its top pocket.

As a result of a simple bottom offset of the pocket profile, a bottom pocket is created which is open at the top and into which, consequently, a price ticket is able to be inserted from above.

In the case of a storage bin which is not divided in the width direction, the width of such a pocket profile will be clearly smaller than the holding bar, it is possible, however, for one continuous or several individual pocket profiles to be fastened side by side on the holding bar until they cover approximately the entire length of the holding bar.

In order to avoid the pocket profile slipping along the holding bar, it is secured in relation to the holding bar by means of a holding element through an opening in its top pocket.

The non-return device between the presentation chamber and the removal chamber consists as usual of pivotable blocking clips which, by way of their region below the pivot bearing arrangement, are able to pivot substantially only in the direction of the removal chamber in order to be able to push a product from the presentation chamber through the non-return device into the removal chamber, but not in the reverse order.

In this case, the pivotable blocking clips end above the cross struts located below them, naturally at such a spacing which no longer allows a product to be pushed through. Preventing the pivoting in the direction of the presentation chamber is achieved as a result of there being a stop rod above the bearing arrangement of the blocking clips which is realized by a rod, and the blocking clips comprise a protrusion upward beyond the bearing arrangement rods which strikes against the stop rod when pivoting in the wrong direction.

To push the products simply through the non-return device, the scoop pusher which is utilized for this purpose has a specially developed scoop-shaped operating end:

The inside surface of the scoop is concavely curved, just as in the case of a scoop, and in a top view onto said inside face, the scoop has an approximately triangular structure with a central, strongly rounded tip on the front end, which is located opposite the pusher bar, as well as two further continuations, which each point to the side on both sides and are strongly rounded, as a second and third corner of the triangle at the rear end of the scoop.

The edge of the scoop has in each case an indentation between the rounded tip at the front and the lateral continuations.

Using the front rounded tip of the scoop, it is possible to engage over products lying right at the back and pull them forward. Holding the scoop at an angle, products can be very easily pushed to the side by means of the lateral continuations, even when they are located in one of the front corners of the presentation chamber.

The effect of the indentations in between is that other products that are located close by and are not wanted are not unintentionally entrained.

The transparent pane, which closes the front side of the presentation chamber, is not fixedly mounted, but can be opened, among other things for filling the presentation chamber also from the front. However, it must not be possible for the customer to open the pane which is realized as a front door. At the same time, the presence of a lock on each of the panes should be avoided as sooner or later the key required for it will be lost, the lock poses a hygiene problem and for other reasons.

For this reason, the pane, which is realized as a front door and is fastened on one side to the frame by means of hinges, has on the side located opposite the hinges simply a locking device which can be opened without a key or a special tool, the locking device, however, not being visible to the customer, and consequently not being opened by said customer. For example, a locking bolt projects rearward somewhat out of one of the upright struts which has to be raised by the operator so that the front door, which is located in front and is realized as a transparent pane, is able to be opened.

In addition, in the covered front on each storey there must be a pusher opening through which the pusher bar extends, which the customer holds in his hand at the rear outside end, the handle, and with which he pushes the desired product in the presentation chamber into the removal chamber though the non-return device.

Said pusher opening is not produced as a fully surrounded opening in the individual panes, but the spacing at the level between two panes which are arranged one above another is used as such a pusher opening. For this purpose, each of the panes extends beyond the front edge, in particular the front top edge, of one of the storage bins and consequently covers part of the presentation chamber which is situated above and also part of the presentation chamber which is situated below said storage bin.

As the pusher opening is not required over the entire width of the presentation chamber, the panes, which are arranged one above another, are arranged at a very small spacing of a few millimeters, which is smaller than the thickness of the pusher bar, however, either in the bottom edge or in the top edge of the pane there is an indentation which, in its region, enlarges the spacing between the two panes to such a dimension that the pusher bar is able to extend through, but not the clearly thicker handle and also not the clearly larger scoop at the front end.

In order to present the products in a clearly visible manner in the presentation chambers, a light strip, in particular an LED light strip, extends along each presentation chamber on both sides of the top edge region thereof, in the depth direction, and illuminates the products in said presentation chamber. By using LEDs as lamps, less heat is input onto the products.

By the light strip being fixedly arranged in relation to its holder, the beam direction onto the products cannot be changed unintentionally, rather the light always shines onto the products at the same previously established beam direction and with the same beam cone.

The closed cover surface, that is the top surface, of the display rack which, as a rule, is closed by a glass plate, has a slight gradient from the front edge to the rear edge. The effect of said measure—in addition to or as an alternative to this, is also a position of the front edge higher than 1.80 m, preferably higher than 1.85 m—is that the customer standing in front of the display rack cannot see the cover surface and consequently cannot notice any dust that has possibly been deposited thereon. For this purpose, however, the slope must not be greater than 5°, preferably not greater than 10 degrees, preferably not greater than 5 degrees as otherwise it would be possible to see through the glazed cover surface from below.

EXEMPLARY EMBODIMENTS

Figure 2A:
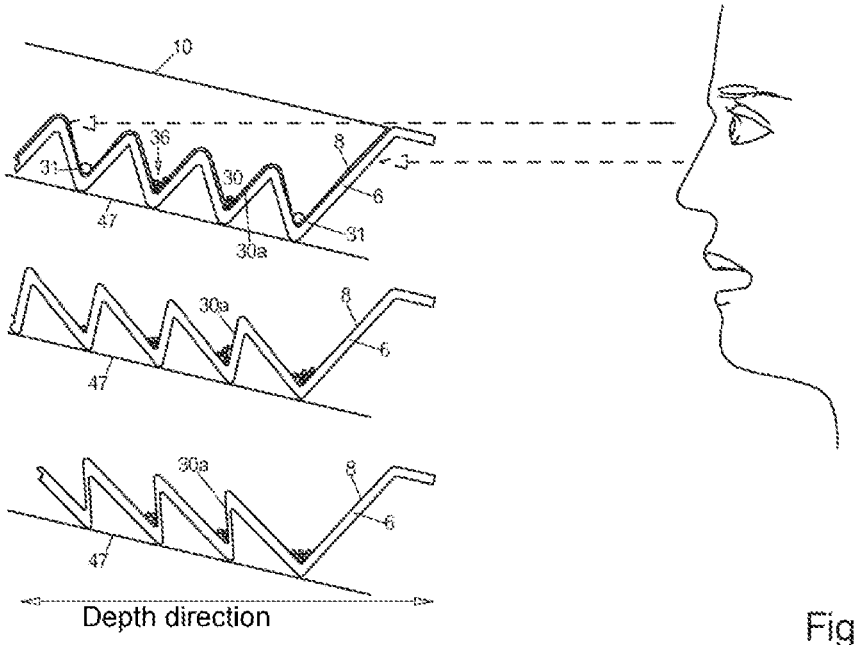
Figure 2B:
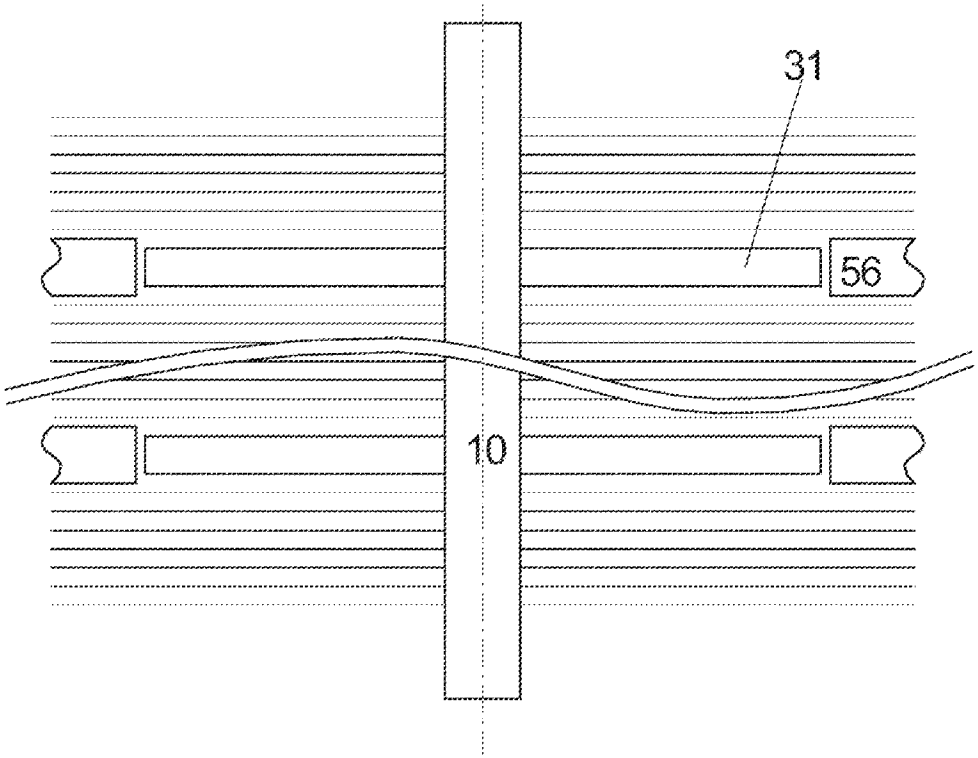
Figure 3A:
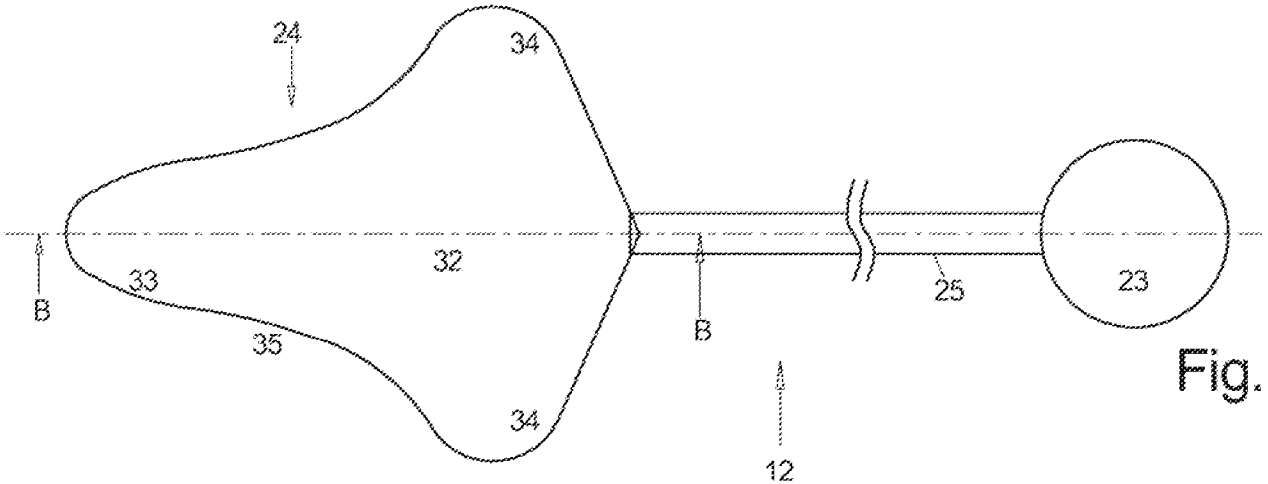
Figure 4:
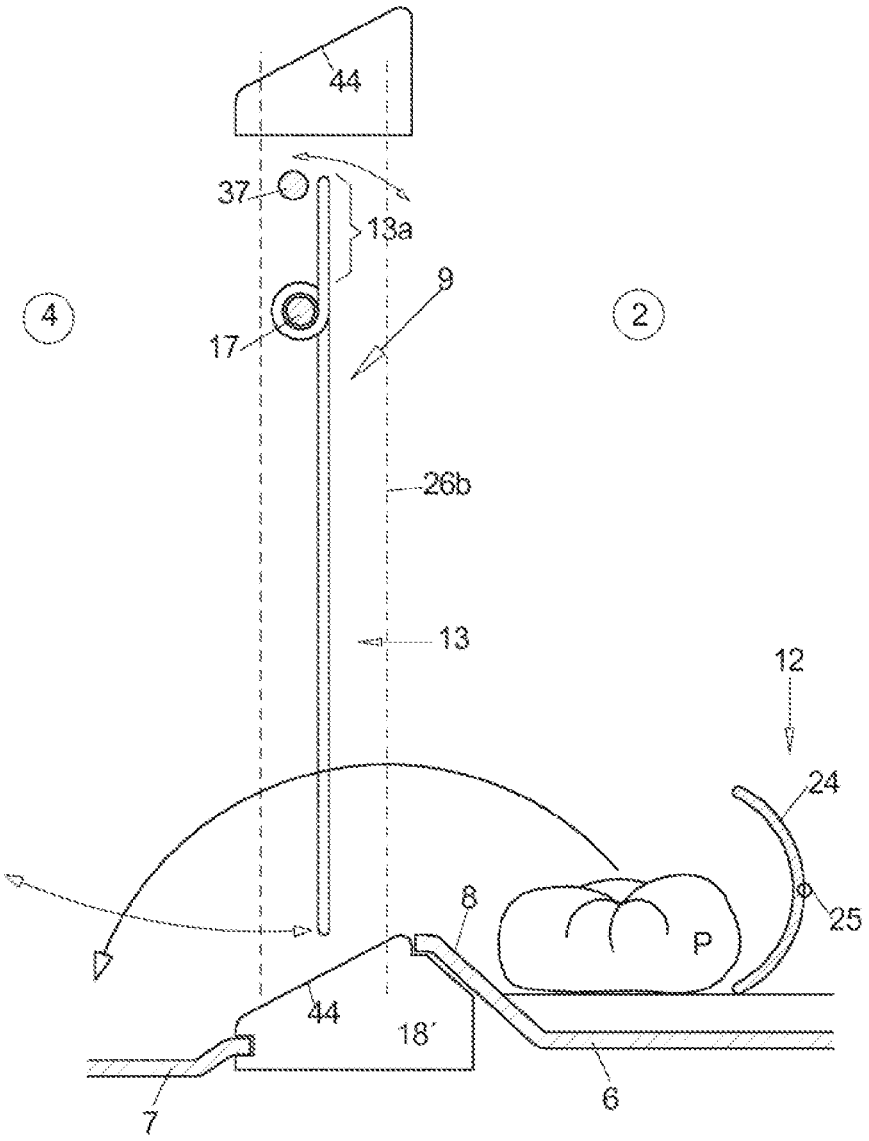
Figure 5A:
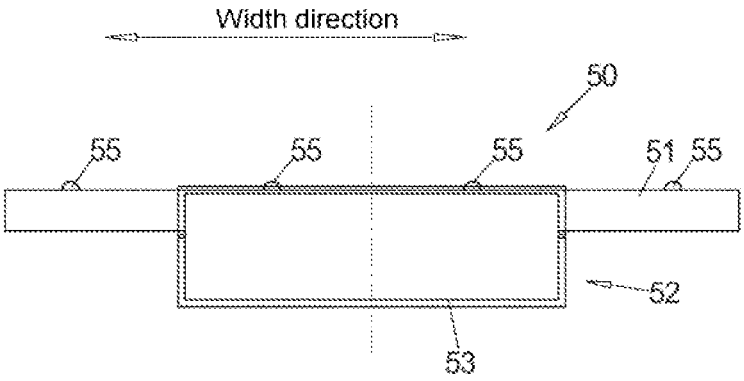

An exemplary embodiment of the invention is described below by way of the accompanying drawings, in which:

FIGS. 1*a, b*: show a side view and front view of the display rack,

FIG. 2*a*: shows an enlargement of a detail, seen in side view,

FIG. 2*b*: shows a top view of the enlargement of the detail in FIG. 2*a*, FIGS. 3*a, b*: show the scoop pusher, FIG. 4: shows an enlarged representation of the non-return device and FIGS. 5*a, b*: show representations of the detail of the price strip.

Figure 1B:
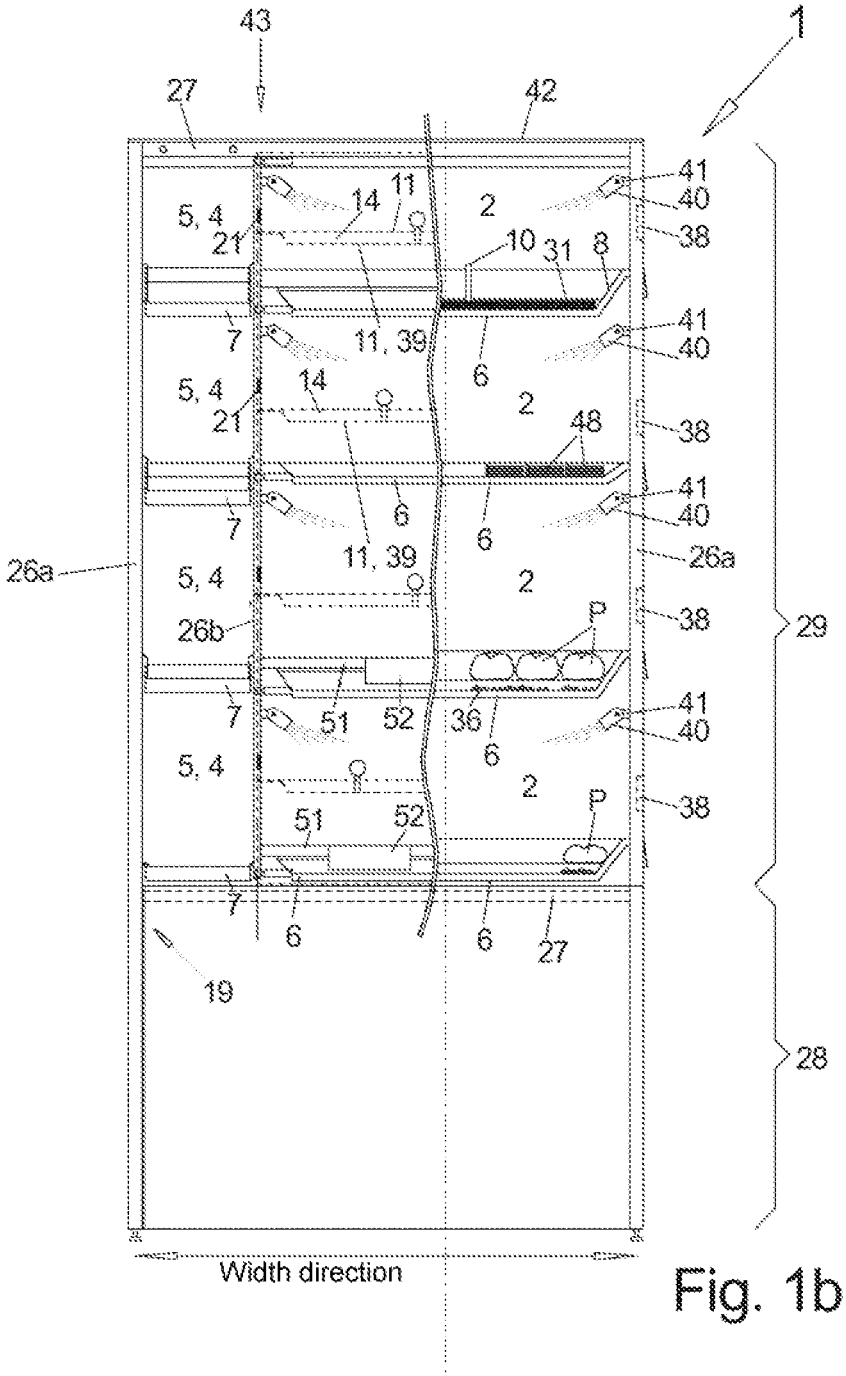

The front representation in FIG. 1*b* of an individual display rack 1 shown over the entire height shows the fundamental innovation, according to which the removal chamber 4—in individual storeys one above another—is situated in each case to the side, in this representation to the left-hand side, next to the presentation chamber 2 for the goods.

A product P, which is already located in the removal chamber 4, is able to be reached there and removed by the customer via the removal opening 5, which is present on the front side of said removal chamber 4 and, in this case, exists in the overall open front side of the removal chamber.

The presentation chamber 2, in contrast, is closed to the front, to the user, by means of a transparent pane 11, through which the customer, however, is very clearly able to see the products P that are stored in the presentation chamber 2:

The separating plane 43 then, which is located between the presentation chamber 2 and the removal chamber 4 and in which a non-return device 9 has to be situated by way of, in this case, several pivotable elements 13, extends in the direction of sight of the customer and is not too obvious in the front view, in contrast to a transversely extending non-return device which is necessary when the removal chamber 4 is situated in front of the presentation chamber 2 as in the prior art.

The upper region of the display rack 1, in which the presentation chambers 2 and removal chambers 4 are situated in each case side by side, is the presentation region 29 which reaches approximately up to knee height of the customer standing in front of it, the base region 28, which is located beneath it, no longer includes presentation chambers or removal chambers.

In addition, the front side 3 of the presentation region 29 is developed so as to slope backward from bottom to top, preferably by approximately 5-10° in relation to the vertical, as a result of which looking into the presentation chambers 2 is improved not only in a horizontal manner but also relatively steeply from above, the more so when the products P are located close to the front pane 11 in the individual presentation chambers 2.

As can be seen from FIGS. 1*a, b*, the structural design of the display rack 1 is modular:

It consists on the one hand of a frame 19 which consists of upright struts 26*a, b, c*, the upright struts being designated at the front side 3 by the reference 26*a* or 26*b:*

As the front side 3 of the presentation region 29 is arranged sloping backward from bottom to top and the front face of the base region 28 is, however, arranged perpendicularly, the front-side upright struts 26*a*, which pass through the presentation region 29 and the base region 28, have a bend at the transition between these two regions or are divided into two at said point, the bottom part forming a separate foot support 15. The upright struts on the front side 3 which only extend over the height of the presentation region 29 are designated by way of the reference 26*b*.

Such a front-side upright strut 26*b* which only extends over the height of the presentation region 29 is preferably present in each case on a side of the removal chamber 4 that is certainly narrower than the presentation chamber 2, it not being important on which side of the removal chamber 4 this is chosen to be. In the case of display racks 1 which follow one after another in a modular manner in the width direction, as indicated in the top region in FIG. 1*b*, this should be the same side in each case.

The sense in this is that in the base region 28 the upright struts, which reach to the floor, are at a spacing to one another in the width direction which is greater than the width of a commercially available brush, which is wider than the width of the removal chamber 4, which is relatively narrow compared to the presentation chamber 2:

For the front side 3 of the base region is closed by means of a front plate 16 which is realized as a flap with a hinge on the top edge, and with its bottom edge is able to be pivoted forward out of its normal position hanging down vertically away from the remaining display rack 1, that is the foot supports 15, and in particular is only able to be pivoted in this direction.

This serves to ensure that, when the floor 20 is being cleaned, the small crumbs, lying underneath the display rack 1 for example, are able to be pushed from the rear side 22 forward beyond the front side 3 by means of a brush, by the operator, standing behind the rear side of the display rack, deflecting the front plate 16 forward with the brush. The small crumbs then remain on the floor in the region in front of the front side 3 of the display rack and there are picked up, for example, by a polishing or sweeping machine going through its paces.

The upright struts 26*c* on the rear side 22 extend in a perpendicular manner over the entire height, however, there too, the upright struts should extend preferably only on one side of the removal chambers 4 only over the height of the presentation region 29 from the named floor.

The frame 19 is completed by cross struts 18 which extend in the depth direction and longitudinal struts 27 which extend in the width direction, longitudinal struts 27 preferably only being present at the top and bottom end of the presentation region 29.

On each storey, a storage bin 6 is pushed into the frame 19 in the depth direction as the floor of the presentation chamber 2 and in each case a removal bin 7 is pushed into the frame 19 in the depth direction as the floor of the removal chamber 4, said bins serving as a support surface for the products P. Said bins, in this case, rest on lateral guide strips 18', which extend as the cross struts 18 in the depth direction between the front and the rear upright struts 26*a, b, c* and are easily demountable, which is why they have the same slight slope downward from back to front as the bins located thereon are to have.

As can be seen from FIG. 1*a*, said slope increases slightly from bottom to top from storey to storey in order to improve visibility, it being possible for the bottommost storey still to be horizontal.

The fundamental function of the display rack when a product P is removed can be seen best in FIG. 4:

The customer selects a product P to be bought which is in the storage bin 6 in the presentation chamber 2. As the front side of the presentation chamber 2 is closed and he is not able to reach into it, he must select the desired product by means of a scoop pusher, which projects inward through a slot in the front-side cover of the presentation chamber 2 and which he holds by the rear handle 23 in order to move the desired product by way of the scoop 24 at the front end of the scoop pusher 12 through the non-return device 9 into the removal chamber 4.

The handle 23 of the scoop pusher 12 is realized, in this case, as a ball, as can be seen in FIG. 1*a* or FIGS. 3*a, b*, which is, however, not compulsory.

To this end, he has first of all to push the product P up over the lateral ramp 8 of the storage bin 6, then push it through the non-return device 9, which occurs on its own due to gravity by there being a sliding surface 44 which slopes downward in the direction of the removal bin 7 below the non-return device 9. As soon as the product P rests on the removal bin 7 of the removal chamber 4, the customer is able to reach it with his hand through the front-side removal opening 5 of the removal chamber 4, put it in a bag and take it with him.

So that said pushing-over is not possible over the entire depth of the display rack, a protective plate 20 is arranged, for example, in the separating plane 43 in the rear region, and the non-return device 9 with the pivotable blocking clips 13 only covers the front region.

The non-return device 9 consists of pivotable elements 13—as can also be seen in FIG. 1*a*—which, side by side in the depth direction, form a continuous curtain, in this case of wire clips which are strung in a pivotable manner along a bearing rod 17. The pivotable elements 13 end with their bottom end at a spacing above the slipping surface 44, the spacings being too small in order to pass a product P through between them.

The pivotable elements 13 have an protrusion 13*a* upward beyond the bearing rod 17, and in the pivot region of said protrusion 13*a* is situated a stop bar 37 which extends parallel to the bearing rod 17 and, just as said bearing rod, is suspended at the end of the upright struts 26*b, c*, offset somewhat from the protrusion 13*a* in the direction of the removal chamber 4.

As a result, the bottom part of the pivotable element 13 is only able to pivot by a small pivot angle in the direction of the presentation chamber 2, just until the protrusion 13*a* abuts against the stop rod 37, and then the bottom end of the pivotable element 13, the blocking clip, is still situated for instance above the sliding surface 44. As a result, products already situated in the removal chamber 4 are reliably prevented from being able to be pushed back again into the presentation chamber 2 by the customer.

In contrast, the blocking clip 13 can be pivoted an arbitrary distance in the other direction, that is in the direction of the removal chamber 4, as is necessary in order to push a product P through.

In this case, both the bearing rod 17 and the stop bar 37 extend preferably parallel to the storage bin 6 and above all parallel to the guide strip 18', which extends in the depth direction, and are consequently angled differently for the most part according to the storey.

The storage bins 6 are usually filled with fresh products P from the rear side 22, insofar as there is space there for the operator. If the display rack 1, however, has to stand with its rear side 22 against a wall, for example for reasons of space, the filling by the operator must take place from the front side 3.

For this purpose among other things, the panes 11 which cover the front side 3 of the presentation chambers 2 are realized for opening by being fastened on one side to one of the upright struts 26*a, b* by means of hinges 21.

On the other side, opposite the upright struts 26*a, b* which extend there, each pane has a locking device 38 which is, however, not visible to the customer:

As the enlargement of the detail in FIG. 1*a* shows, said locking device consist, for example, of a lock 45 which protrudes from the rear side of the upright strut 26*a* and which can be reached under and pushed up with the result that its locking end 45*a* then no longer engages in the closure part 46 which is fastened on the rear side of the pane 11 such that the pane 11 is able to be pivoted up.

As soon as this happens, the storage bin 6 located behind it is able to be charged with new products or the storage bin 6 is also able to be removed forward completely for cleaning purposes or so that it can be filled somewhere else.

To this end, a form-locking latching (not shown) has first of all to be overcome between the storage bin 6 and the guide strips 18' on which it rests, as a rule by lifting up the storage bin 6. The same also applies to the removal bin 7.

It can be seen from FIG. 1*a* that the cover surface 42 of the display rack 1, which is closed by elements such as, for instance, glass panes that are placed onto the frame 19, has a gradient that slopes down slightly from the front edge to the rear edge so that the top surface of said cover surface is not visible to a customer standing in front of the display rack 1.

FIG. 1*b* shows a sectional representation of the storage bins 6 in the right-hand part and a front view only in the left-hand part.

Several details can be seen above all from the sectional representation:

On the one hand that the storage bins 6 are realized in a bin-shaped manner, that is they comprise an ascending ramp 8 toward their edges, which ramp, among other things, is to prevent a product being able to be pushed too easily and unintentionally by a customer over the edge of the storage bin 6 into the removal chamber 4. In addition, said lateral ramp 8 also serves for holding back products, if the storage bin 6, charged with products, is moved, for example is carried around, outside the display rack 1.

As can be seen among other things together with FIG. 2*a*, the floor of the storage bin 6 is provided with grooves 30 which extend over the entire width of the floor of the storage bin 6 and one groove 30 connects to the next groove in the depth direction such that a W-shaped or V-shaped development of the floor of the storage bin is provided. The elevations between the grooves 30, in this case, form the support surfaces for the products P, for the width of the grooves 30 is clearly smaller than the extension of a product P when seen in top view.

In this case, the storage bins 6 and the entire display rack 1 are dimensioned such that the storage bins 6 can only be pushed into the display rack 1 in one orientation, namely just with the grooves 30 extending transversely to the depth direction.

In this case, the grooves 30 serve as a collecting space for small crumbs 36 or constituents such as grains of cereal which fall off the products P such that the storage bins 6 developed in this manner simultaneously fulfill the function as a support surface for the products P and as a collecting tray for small crumbs.

In this case, the flank inclination and the depth of the grooves 30 is additionally preferably chosen—with consideration to the inclined position of the storage bin 6 in the display rack 1 and the sight position of the customer—such that at least in the topmost storey the customer is not able to see into the bottom, that is the deepest region, of the grooves 30 and consequently cannot see the small crumbs 36 stored there such that the visual impression to him is of a clean storage bin 6.

This is promoted by a front flank 30*a* of the groove 30 which is as steep as possible, faces the customer and should consequently preferably be perpendicular or even overhanging in relation to the main plane 47 of the storage bin 6, as shown in the bottom representations of FIG. 2*a*.

FIG. 1*b* also shows that there are differently developed storage bins 6, for example with a different depth, that is the lateral ramps 8 are of different heights.

In addition, it can be seen that there are also storage bins 6 without grooves 30 in the floor, in which non-crumbling products such as, for example, paper bags are to be stored which can then be presented, for example, on the bottom-most storey, for which the omission of the pane 11 is also an option in order to be able to reach the bags 48 directly in the presentation chamber 2 and to be able to take them out from the front.

The panes 11 extend vertically in each case beyond one of the storage bins 6 and consequently at the same time, in each case in part, cover two presentation chambers 2 which are located one above the other. The slot-shaped pusher opening 14, which is required for passing through the pusher scoop 12 and has to extend over a certain length in the width direction, is formed by a vertical spacing between two vertically consecutive panes 11. As the pusher opening 14 does not have to extend over the entire width of the presentation chamber 2, it is created as a result of either the bottom edge or the top edge of the adjoining panes 11—which are shown by the dotted lines in FIG. 1*b*—comprising an indentation 39 which is situated in the central region of the width of the presentation chamber 2. The bottom edge of the top pane is located in the side regions next to the indentation 39 very close to, only a few millimeters above the top edge of the pane located below it.

The height of said pusher opening 14 which is created in this manner is greater than the thickness of the pusher rod 25 which is indeed to pass through the pusher opening 14, but smaller than the diameter of the handle 23 on the rear end of the pusher rod 25 and also smaller than the dimensions of the scoop 24 at the front end of the pusher rod.

A partition wall 10, which projects up from the floor of the storage bin 6 extending in the depth direction in order to divide the storage bin into two adjacent regions, is additionally shown on the topmost storey in FIG. 1*b*.

The partition wall 10 is preferably not fixedly connected to the storage bin 6, but rests loosely on said storage bin. Fixing is effected—as shown in FIGS. 2*a* and 2*b*—in a form-locking manner and consists, in this case, of two correspondingly spaced heavy bars 31, preferably consisting of metal, which fit in grooves 30 and preferably extend over their entire length. The partition wall 10, which projects upward and extends at a right angle to the bars 31, is fastened to said bars such that, where required, the partition wall 10 can be arranged in the storage bin 6 simply by placing its bars 31 into the grooves 30.

If the bar 31 is shorter than the length of a groove 30, the cross position of the partition wall 10 in the storage bin 6 can also be varied. For this purpose, stops 56, against which the bars 31 strike at the front end, are included at corresponding cross positions in the grooves 30.

Light strips 40 for the illumination of the presentation chambers 2 on the individual planes are additionally shown in FIGS. 1*a* and 1*b:*

In this case, these are preferably light strips with LEDs as lamps which not only require little current but above all radiate very little heat, and as a result, do not give rise to any inadmissibly high heat input in the direction of the products P stored in the presentation chamber 2.

The light strips 40 are arranged in each storey in the right-hand and left-hand top corner of the presentation chamber 2 extending in the direction of the depth of the display rack 1 and are preferably fastened on the bottom surface of the guide strips 18'.

In this case, the light strips 40 are not mounted so as to be pivotable about their longitudinal axis in relation to their end-side holder 41 such that the beam angle of the light strip 40 is always set in an optimum manner. The power supply to the light strips is effected by wiring which is run in the interior of the struts of the frame 19 which, for this reason, are preferably realized with regard to their cross section as extensively closed hollow profiles.

The special form of the scoop 24 of the scoop pusher 12 can be seen in FIGS. 3*a, b:*

Figure 3B:
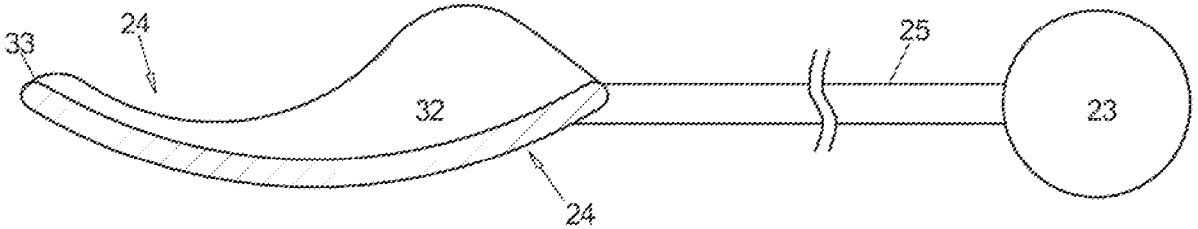

It can be seen from the sectional representation in FIG. 3*b* that the inside surface 32 of the scoop 24 is curved in a concave manner and the pusher rod 25 is positioned on the rear end of the scoop 24.

In the top view from above onto the inside surface 32 according to FIG. 3*a*, it can be seen that the scoop 24 has an approximately triangular basic form with a central, strongly rounded tip at the front end remote from the pusher rod 25, and on both sides of the longitudinal center, the line of symmetry, a continuation 34 which projects laterally to each side, both of which continuations provide one each of the further corners of the triangular basic form and are also strongly rounded.

Indentations 35 are present in each case between the central tip 33 and the lateral continuations 34. As a result of said form, on the one hand, where required, a product can be received in the concavely scoop-shaped inside surface 32 and as it were carried.

As a result of the tip 33 at the front and the lateral continuations 34, depending on the position of a product P in the storage bin 6, each product, even in the corners of the storage bin 6, is able to be easily reached and pushed in the desired direction, namely in the direction of the removal chamber 4:

The lateral continuations 34 are especially suitable for reaching a product lying precisely in the front corners of the storage bin 6. The central rounded tip 33 is especially suitable for engaging over a product lying right at the back in the storage bin 6 and pulling it forward into the region of the non-return device 9, and only then pushing it to the side in the direction of the removal chamber 4 by means of one of the two continuations 34.

The size of the scoop 24, when looked at in top view, is somewhat larger than a product P when looked at in top view, but larger by no more than the factor 2 or 3.

The indentations 35 are not so large that a product P could be passed through between an imaginary connecting line from the central tip 33 to a lateral continuation 34 and the indentation 35 lying below it.

FIGS. 5*a, b* show the price strip 50 which is preferably arranged at the level of each storey, that is approximately at the level of the storage bin 6 of the presentation chamber 2.

The price strip 50 consists, on the one hand, of a holding bar 51 which extends behind the pane 11 in the width direction and in front of the corresponding presentation chamber 2 or the corresponding storage bin 6 and has such a length that it is able to be fastened, in particular suspended, by way of its two ends on in each case one of the two upright struts 26*a, b* on both sides of the presentation chamber 2.

The holding bar 51 supports a pocket profile 52 which is preferably produced from transparent plastics material and is cut to the desired length.

Figure 5B:
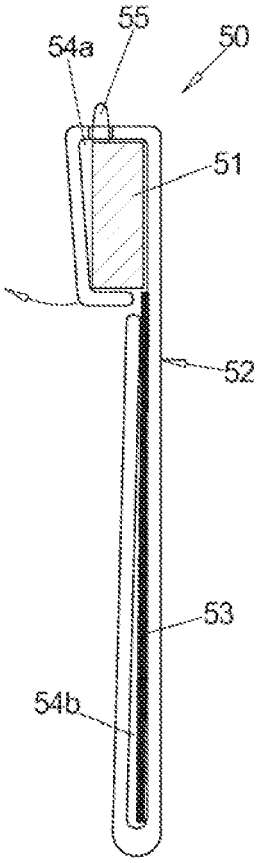

The pocket profile, the profile shape of which can be seen the best in the representation in FIG. 5*b* when viewed in the direction of extension of the holding bar 51, has a top pocket 54*a* into which the holding bar 51 passes, in this case realized by a triple offset about in each case approximately 90° in the same direction from the main plane of the pocket profile 52.

In this case, the bottom freely ending leg reaches almost to the rear side in the main plane of the pocket profile 52.

Once the pocket 54*a* has been correspondingly bent up, the holding bar 51 can be placed from above onto the holding bar 51.

In the bottom region of the pocket profile, this forms a U-shaped pocket 54*b* which is open at the top and into which the price ticket 53 can be inserted from above or from the side with the labelled side facing the customer.

For the positioning in the width direction, in the top surface of the top pocket 54*a* of the pocket profile 52 there is at least one opening, through which a fixing projection 55, which protrudes from the holding bar 51, in this case upward, projects outwardly and as a result fixes the pocket profile 52 in a form-locking manner in the width direction.

As there are several such fixing projections 55 along the holding bar 51, preferably at the same spacing at which the openings are situated in the pocket profile 52, the pocket profile 52 is able to be positioned at several defined positions along the holding bar 51.

LIST OF REFERENCES

1 Display rack
2 Presentation chamber
3 Front side
4 Removal chamber
5 Removal opening
6 Storage bin
7 Removal bin
8 Ramp of the storage bin
9 Non-return device
10 Partition wall
11 Pane
12 Scoop pusher
13 Pivotable blocking clip
13*a* Protrusion
14 Pusher opening
15 Foot support
16 Front plate
17 Bearing rod
18 Cross strut
18' Guide strip
19 Frame
20 Lateral protective plate
21 Hinge
22 Rear side
23 Handle
24 Scoop
25 Pusher rod
26*a-c* Upright strut
27 Longitudinal strut
28 Base region
29 Presentation region
30 Groove
30*a* Front flank
31 Bar
32 Inside surface
33 Tip
34 Lateral continuation
35 Indentation
36 Small crumb
37 Stop rod
38 Locking device
39 Indentation
40 Light strip
41 Holder
42 Cover surface
43 Separating plane
44 Slipping surface
45 Lock
45*a* Locking end
46 Closure part
47 Main plane
48 Bag
50 Price strip
51 Holding bar
52 Pocket profile
53 Price ticket
54*a,b* Pocket
55 Fixing projection
56 Stop
P Product

The invention claimed is:

1. A display rack for the presentation and dispensing of products which have to be protected in a hygienic manner, in particular foodstuffs, to a customer, said display rack having at least two presentation chambers for storing and visually presenting the products, each having a front side which faces a customer, a rear side which is remote from a customer as well as a left-hand side and a right-hand side, at least two removal chambers each having a removal opening for the removal of products from the display rack, wherein the presentation chambers and removal chambers are situated in storeys one above another respectively and in particular a non-return device is provided in each storey between the presentation chamber and the removal chamber, wherein in each storey at least one removal chamber is arranged on the right-hand and/or left-hand side of the presentation chamber; and wherein at least two transparent panes are arranged one above the other as front covers for the front sides of the presentation chambers to define a pusher opening in a width direction, the pusher opening being configured to allow a pusher rod to pass through the pusher opening, so that one of the panes overlaps the two presentation chambers and thereby covers a part of the front side of the upper presentation chamber and also a part of the front side of the lower presentation chamber.

2. The display rack as claimed in claim 1, characterized in that the display rack includes a frame with upright struts; cross struts which extend between the upright struts from adjacent the rear side to adjacent the front side; and longitudinal struts which extend between the upright struts from adjacent the left hand side to adjacent the right-hand side.

3. The display rack as claimed in claim 1, characterized in that a floor of the presentation chamber and/or of the removal chamber comprises consecutive grooves which extend in the width direction of the display rack at least on a top surface.

4. The display rack as claimed in claim 1, characterized in that the display rack includes a price strip having a holding bar which is suspended between two upright struts extending in the width direction on each storey in particular at the height of the front edge of a storage bin and a pocket profile where the holding bar extends through a top pocket, whilst a price ticket is situated in a bottom pocket, wherein the pocket profile is transparent at least in a region of the price ticket.

5. The display rack as claimed in claim 1, further comprising a pusher rod passing through the pusher opening and connected to a scoop with a concavely curved inside surface, and/or, when viewed in top view onto the inside face, indentations are present between a rounded tip and lateral continuations which project to the side on both sides of the scoop.

6. The display rack as claimed in claim 1, characterized in that each pane of the two panes extends vertically beyond the top edge of each storage bin and comprises an indentation which is present in the central region either along its top edge or along its bottom edge, whilst in particular the other bottom or top edge extends in a continuously straight manner.

7. The display rack as claimed in claim 1, characterized in that a light strip, in particular an LED light strip, is arranged in each storey of the presentation chamber below the storage bin arranged above it, extending in the depth direction along in particular the frame and the light strip comprises in particular a fixedly predefined beam direction and a fixedly predefined beam cone.

8. The display rack as claimed in claim 1, characterized in that a cover surface of the display rack is closed in particular by a glass plate, and slopes from the front edge to the rear edge, in particular inclined by a maximum of 5°, preferably a maximum of 10°, preferably 15° in relation to the horizontal and/or the front edge is higher than 1.75 m, preferably 1.80 m in relation to the bottom end of the upright struts.

9. The display rack as claimed in claim 2, characterized in that, offset upward from a bottom end of the upright struts, the longitudinal struts and cross struts cooperate with the upright struts at a transition between a presentation region located above, in which the presentation chambers are arranged, and a base region located below in which not any presentation chambers are arranged.

10. The display rack as claimed in claim 2, characterized in that the, in particular all the, struts are closed hollow profiles in cross section, in which electrical wiring is run for the illumination of the display rack.

11. The display rack as claimed in claim 2, characterized in that the front side of the base region of the frame is substantially closed by a front plate which is fastened by way of its top edge in an articulated manner on the frame, in particular the bottommost longitudinal strut, such that, with its bottom edge, it is only able to be pivoted away from the display rack, and the front plate bears in particular against the front face of the front upright struts.

12. The display rack as claimed in claim 2, characterized in that guide strips, which extend in a depth direction of the display rack on the frame, are present in several storeys one above another, in each case on both sides, in the case of each presentation chamber and each removal chamber for the inserting and placing in position of a storage bin or a removal bin, and the guide strips comprise a form-locking locking device against unintended removal of the bin.

13. The display rack as claimed in claim 2, characterized in that a door pane is mounted on the frame as a front door by means of a hinge on one side, and a locking device which is not visible from the front side and in particular the rear side of the display rack is open.

14. The display rack as claimed in claim 9, characterized in that the longitudinal struts are only present at the top end of the frame and at the transition between the base region and the presentation region.

15. The display rack as claimed in claim 9, characterized in that upright struts are present between the presentation chamber and the removal chamber, however, the upright struts end downward at the transition between the presentation region and the base region.

16. The display rack as claimed in claim 12, characterized in that the non-return device includes pivotable blocking clips with a bottom end above the guide strips and the pivotable blocking clips comprise an upper protrusion projecting beyond a bearing rod which carries them, and a stop rod which extends in particular parallel to the bearing rod is arranged in the pivot region of the upper protrusion on the side of the removal chamber for defining the pivotability of the pivotable blocking clip.

17. The display rack as claimed in claim 3, characterized in that a partition wall is fixedly connected by way of a bottom surface to at least one bar which fits into one of the grooves, and stops are realized for the ends of the bar.

18. The display rack as claimed in claim 3, characterized in that the grooves have such a depth that any contaminants collected there such as for instance small crumbs are not visible to the customer at least in the topmost plane of the display rack.

19. The display rack as claimed in claim 3, characterized in that the presentation chamber and/or the removal chamber are realized in a trough-shaped manner with different heights.

20. The display rack as claimed in claim 4, characterized in that the pocket profile comprises an opening in a region of the top pocket, and a fixing element, in particular a fixing projection of the holding bar, extends through the opening.

21. A display rack for the presentation and dispensing of products which have to be protected in a hygienic manner, in particular foodstuffs, to a customer, said display rack having at least one presentation chamber for storing and visually presenting the products, having a front side which faces a customer, a rear side which is remote from a customer as well as a left-hand side and a right-hand side, at least one removal chamber having a removal opening for the removal of products from the display rack, wherein in particular a non-return device is provided between the presentation chamber and the removal chamber, characterized in that the at least one removal chamber is arranged on the right-hand and/or left-hand side of the presentation chamber; and characterized in that two panes are arranged one above the other to define a pusher opening in a width direction, the pusher opening being configured to allow a pusher rod to pass through the pusher opening;

characterized in that a floor of the presentation chamber and/or of the removal chamber comprises consecutive grooves which extend in the width direction of the display rack at least on a top surface; and characterized in that a partition wall is fixedly connected by way of a bottom surface to at least one bar which fits into one of the grooves, and stops are realized for the ends of the bar.

* * * * *